United States Patent [19]

Kelsey

[11] Patent Number: 4,632,570

[45] Date of Patent: Dec. 30, 1986

[54] TIMER FOR USE IN INTERVAL TRAINING

[75] Inventor: Terry D. Kelsey, Portland, Oreg.

[73] Assignees: Mark Chan, Portland; Kevin Drew, McMinnville, both of Oreg.

[21] Appl. No.: 773,313

[22] Filed: Sep. 6, 1985

[51] Int. Cl.[4] ..... G04F 8/00

[52] U.S. Cl. ..... 368/107

[58] Field of Search ..... 368/107–109, 368/89

[56] References Cited

U.S. PATENT DOCUMENTS

| | | | |
|---|---|---|---|
| 3,969,886 | 7/1976 | Yoda | 368/73 |
| 4,062,180 | 12/1977 | Meshi et al. | 368/96 |
| 4,124,944 | 11/1978 | Blair | 434/234 |
| 4,451,158 | 5/1984 | Selwyn et al. | 368/63 |

*Primary Examiner*—Bernard Roskoski

*Attorney, Agent, or Firm*—Chernoff, Vilhauer, McClung & Stenzel

[57] ABSTRACT

A timer for use during an interval training workout or other practice to measure and to display in countdown form the amount of time remaining in each of a series of sets of exercise periods, each exercise period followed by a rest period, and each exercise period and each rest period having a respective predetermined length. Provision is made for entering the length of the exercise period and the rest period for each set and for timing similar sets of exercise and rest periods a predetermined number of times. A countdown display shows the number of sets of exercise and rest periods remaining to be timed during a programmed workout, and an audible indication is provided at the end of each exercise period and at the end of each rest period. Provision is made to repeat a workout a single time or to repeat continuously the sequence of exercise and rest periods of a workout or practice session.

10 Claims, 4 Drawing Figures

FIG. 4
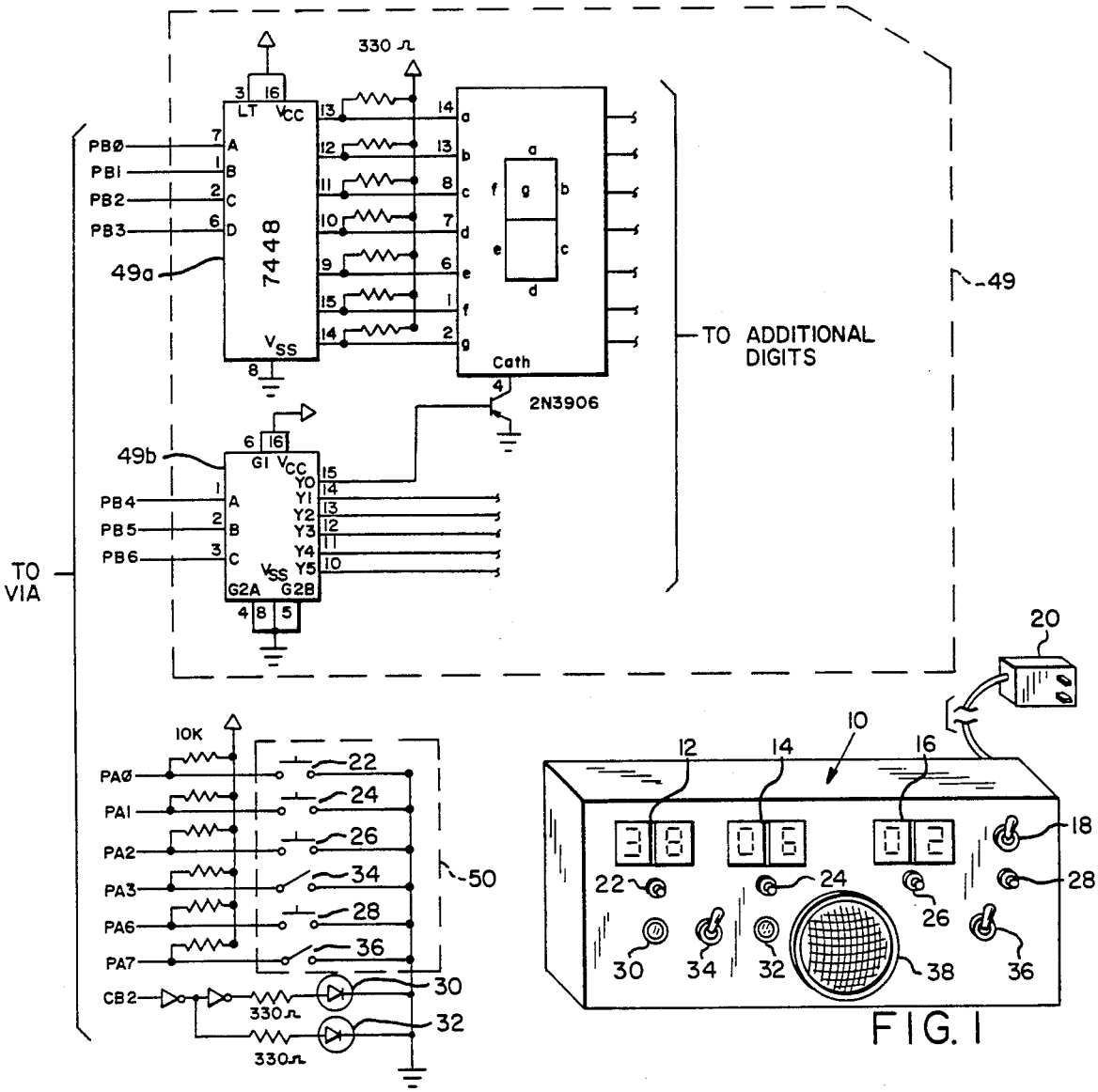
FIG. 1
FIG. 2
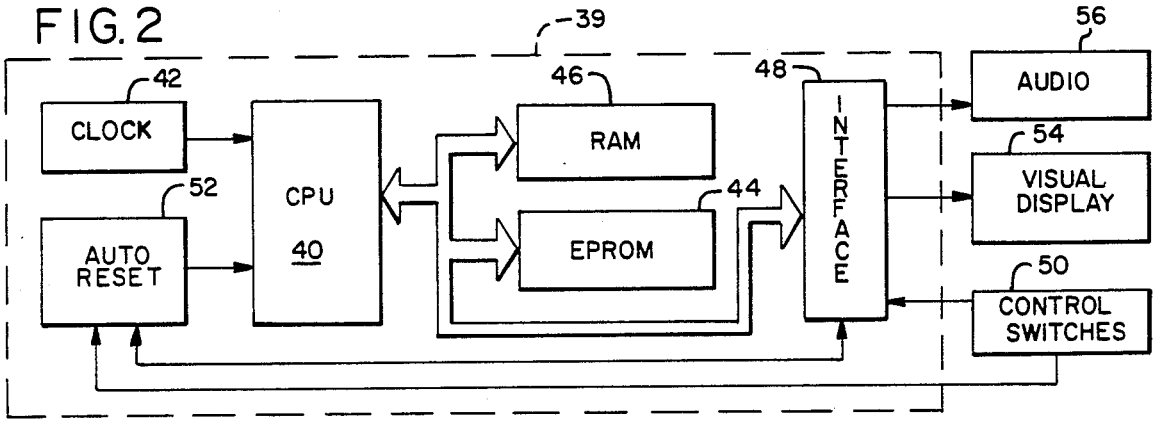

TIMER FOR USE IN INTERVAL TRAINING

BACKGROUND OF THE INVENTION

The present invention relates to devices for timing repetitive exercise periods such as athletic workouts, and more particularly for timing exercises involving alternatingly exercising and resting for predetermined periods of time which together form a complete workout or practice period.

It is believed by many that physical conditioning can be maximized by alternatingly exercising at a strenuous pace for a short period of time and thereafter resting for a short period of time, repeating such sets of exercise and rest several times to complete a workout. Athletes such as runners, boxers, swimmers, wrestlers, rowers, and those attempting to increase body fitness by other aerobic exercises find that interval training is of value. Similar schedules of practice and rest sequences are also valuable in practicing typing, shorthand, and playing musical instruments, when periods of concentration may be alternated with rest periods.

In order to avoid injury, it is best to begin an athletic workout gradually, increasing the intensity of the workout only after muscles have been warmed up by slow or moderate exercise, and blood circulation throughout the body has been increased by such initial exercise. Thereafter, exercise may be carried out at a strenuous level until the muscles being exercised have been sufficiently tired. In order to encourage circulation to continue until waste products from exercise have been removed from muscle cells, it is desirable to continue to exercise at a less strenuous pace after the most strenuous exercise of a workout has been completed. Different lengths of exercise and rest periods are therefore needed at the beginning, middle, and end of a workout or training session.

In the past, there has been no timer available which could be used to keep track of exercise and rest periods easily, to provide for a gradual increase in intensity of a workout, and to provide an indication of the passage of exercise and rest periods of different lengths during a period of cooling off after the most intense portion of a workout. As a result, a coach has had to use a stopwatch or an ordinary clock to time individual periods of exercise and periods of rest in running an interval training program. Similarly, teachers have had to time periods of speed practice and periods of rest manually during shorthand and typewriter instruction.

While timers have been available previously for providing an audible or visible signal to indicate the pace which a runner must use to cover a distance in a desired period of time, such timers do not provide signals indicating the end of each exercise period and the end of each subsequent rest period. Stopwatches which may be used to measure the time elapsed during individual laps in the course of a race are now well known, but, again, such watches do not have the capacity to signal the ends of predetermined amounts of time to be used alternatingly for exercise and subsequent period of rest.

Meshi et al., U.S. Pat. No. 4,062,180, discloses an electronic chess clock which can be used to indicate repeatedly an initial amount of time available for the next move by each of a pair of opposing players, and to display continuously the amount of that initial time which remains, until that time expires or the player completes his move and operates a switch which initiates the opposing player's play period. With such a chess clock, however, each player must initiate the period of thinking time for his opponent by operating a switch at the time he completes his own move. Yoda, U.S. Pat. No. 3,969,886, discloses a digital electronic watch which has a countdown display function and which also includes the capability of providing an audible alarm at the expiration of the time period being counted down, but there is no provision for alternating exercise and rest periods.

Selwyn et al., U.S. Pat. No. 4,451,158, discloses a countdown timer which provides an audible signal at the end of a period of time and which can be reset automatically to again count down the predetermined period of time. Selwyn et al. does not disclose, however, how to provide countdown timing and display of the time remaining in alternating exercise and rest periods of different duration.

Additionally, the prior art known to the applicant does not disclose a timing device which provides a display of the number of sets of exercise and rest periods remaining in a planned workout period. Accordingly, what is desired is a timing device which may be programmed to time and to provide a display of the time remaining in each of a sequence of exercise and subsequent rest periods of differing lengths during a workout, together with a display of the number of sets of exercise and rest periods remaining in the workout. Preferably, such a device should be easily programmable, should be capable of being reset, and should provide the possibility of continuously running to repetitively time a predetermined workout sequence of sets of exercise and rest periods.

SUMMARY OF THE INVENTION

The present invention provides a user-programmable timer for use by athletes in workouts of interval training and by students to time and provide a countdown display of the remaining amount of time in each of a sequence of sets of exercise or practice periods and alternating rest periods. Preferably, an electronic microcomputer having an associated electronic clock circuit is controlled by a program and a memory which accepts inputs of the desired length of each exercise period and rest period. In operation, the device sequentially measures the duration of each programmed exercise period and rest period, providing a continuous display of the amount of time remaining in each such exercise and rest period, and additionally providing a countdown display of the number of sets of exercise and rest periods remaining within a workout which has been programmed into the memory of the timer. Provision is also made for display of an indication of whether the time being displayed is part of a rest period or an exercise period, and different audible signals are provided to indicate distinctively the end of each exercise period and each rest period. A preferred program permits the sequence of sets to be repeated and additionally permits a workout which has been programmed to be continuously repeated or to be temporarily interrupted and later resumed.

It is therefore an important object of the present invention to provide a timer for signaling the duration and ending of each of a sequence of sets of exercise and rest periods.

It is another important object of the present invention to provide a timer providing a visible display of a countdown of the time remaining during each of a sequence of exercise and rest periods.

It is a further object of the present invention to provide a timer which displays the number of sets of exercise and rest periods remaining during a programmed workout or drill.

It is an important feature of the present invention that it provides a timer which can be programmed to time sequentially a series of exercise periods and rest periods of varying lengths.

It is another important feature of the present invention that it provides an electronically controlled digital display of the amount of time remaining during any current exercise or rest period during a workout.

It is a further feature of the present invention that it provides an electronic digital display of the number of sets of exercise and rest periods remaining during a programmed workout.

Yet a further feature of the timer of the present invention is that it can repeat a programmed workout sequence of exercise and rest periods indefinitely.

It is a principal advantage of the present invention that it makes it much simpler to control the lengths of a sequence of exercise periods and rest periods during an interval training workout than when each individual rest and exercise period must be timed manually by the use of a stopwatch.

It is another important advantage of the present invention that it automatically times and announces the ends of exercise periods and intermediate rest periods forming an entire sequence, once the operation of the timer has been initiated to keep track of an interval training workout.

The foregoing and other objectives, features and advantages of the present invention will be more readily understood upon consideration of the following detailed description of the invention taken in conjunction with the accompanying drawings.

BRIEF DESCRIPTION OF THE DRAWINGS

FIG. 1 is a pictorial view of an interval training timer embodying the present invention.

FIG. 2 is a block diagram of the major components of the electronic interval training timer of FIG. 1.

FIG. 4 is a schematic diagram of output portions of the circuit shown in block form in FIG. 2.

DETAILED DESCRIPTION OF THE INVENTION

Figure 3:
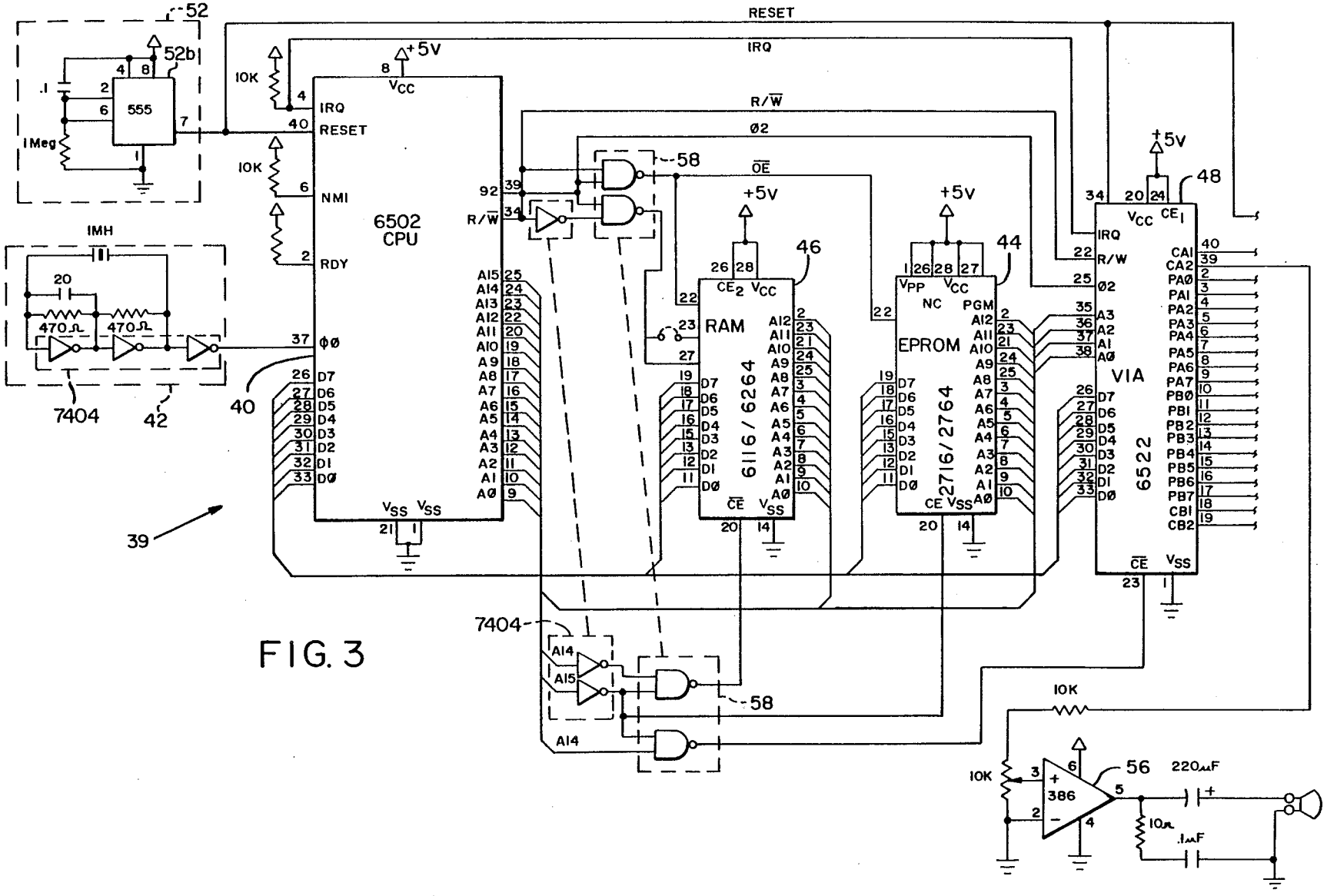
FIG. 3 is a schematic diagram of a part of the circuit shown in block form in FIG. 2.

Referring now to the drawings, an interval training timer 10 shown in FIG. 1 has a digital visual display including a pair of digits 12 to display a number of minutes, up to 99 minutes, and a pair of digits 14 to display the number of seconds remaining in a current minute during either an exercise period or a rest period. A third pair of digits 16 displays the number of "sets" remaining in an interval training workout. Each such set includes an exercise period and, except for the last exercise period in a workout, also includes a subsequent rest period. A power control switch 18 controls whether the entire timer 10 operates, so long as normal AC voltage is provided through the transformer 20, or DC power is supplied by a battery (not shown). A momentary contact push-button "minutes" control switch 22 may be used to establish an initial number of minutes of the duration of an exercise or rest period, and a similar push-button "seconds" control switch 24 may be used to establish an initial number of seconds as a part of an exercise or rest period. A third similar switch, a push-button "sets" control switch 26, is available to be used to provide an input of an initial number of sets to be timed, each including a predetermined exercise time and all except the last including a subsequent rest time.

A "start/pause/clear" function control push-button switch 28 is used to initiate timing workout or drill using the timing clock 10.

An exercise period indicator lamp 30, and a rest period indicator lamp 32, both of which may be light-emitting diodes, are provided to indicate whether the figures displayed in the minutes display 12 and seconds display 14 show the time remaining during an exercise period or a rest period, as applicable.

An "exercise/rest" control switch 34 is used to control the input of initial settings of the timing clock 10 to establish the length of either an exercise period or a rest period when making inputs into the memory of the device by use of the "minutes" push-button switch 22 and the "seconds" push-button switch 24. A "set/run" switch 36 is provided to permit the lengths of exercise and rest periods to be entered. Once all of the exercise and rest times and the number of sets have been input into the timing clock 10, the set/run control switch 36 may be placed into the "run" condition to ready the timer 10.

The initial length of either an exercise period or a rest period may be established by depressing the pushbuttons 22 and 24 repeatedly until the desired initial time is displayed with the "exercise/rest" control switch 34 appropriately in the "exercise" or the "rest" position as made evident by the illumination of the respective one of the exercise and rest indicator lamps 30 and 32. Preferably, the device is programmed to increase the digital settings by one each time the push buttons 22 and 24 are pushed briefly, and to increase the displayed number continuously until released, once the pushbuttons are held depressed more than a predetermined length of time. After the rest and exercise period times have been entered, the number of sets having those exercise and rest times is entered by pressing the "sets" control switch 26 the necessary number of times or continuously for the length of time required to increase the total number of sets displayed by the desired number.

The desired amounts of time may be input into the memory of the timing clock 10 when the "set/run" control switch 36 is in its "set" position.

A loudspeaker 38 is provided to make an audible signal indicating the end of each exercise period of time and each rest period of time.

Referring now to FIGS. 2, 3 and 4, an interval timer 10 according to the present invention is based on a microcomputer 39 designed and programmed specifically to accept inputs of the desired lengths of exercise periods and rest periods, and to measure and display the amount of time remaining in each exercise and rest period, in accordance with the sequence in which the periods are entered into the memory portion of the timer 10. A central processing unit 40 receives a periodic time signal from a clock circuit 42 and operates as directed by a program stored in an erasible programmable read only memory (EPROM) 44, and in accordance with the exercise time, rest time, and set number directions stored in a random access memory (RAM) 46. An interface 48 is used to communicate between the various control switches 50 (including the on/off switch 18, the "minutes," "seconds," and "sets" push-button switches 22, 24, and 26, the "start/pause/clear" control switch 28, the exercise/rest control switch 34, and the set/run control switch 36). The interface 48 also transmits outputs provided from the CPU 40 to the proper components to control the visual displays 54 (the "minutes" display numerals 12, the "seconds" display numerals 14, the "sets" display numerals 16, and the exercise and rest period indicator lights 30 and 32), as well as to provide an audio frequency electrical signal to an audio amplifier 56 to be converted into sound by the loudspeaker 38.

An automatic repeat circuit 52 provides a synchronizing pulse at power-on to initialize the timer. The timer can automatically repeat a workout sequence of sets of exercise and rest periods indefinitely once the sequence has been entered. The automatic repeat feature is enabled by pressing the "start/pause/clear" control switch 28 when the "set/run" switch 36 is in the "set" position. With the set/run switch 36 in the "set" position, the "start/pause/clear" control switch 28 acts as a "clear" control switch. Closing the "clear" control switch returns the displays of the minutes display 12 and seconds display 14, and the values of minutes and seconds entered in the applicable part of the memory of the timer, to zero. This permits correction of erroneous entries. Additionally, leaving the exercise time as zero minutes, zero seconds for the final set enables the automatic repeat sequence. Once the set/run control switch 36 is placed in the "run" position, however, the "clear" function of the push-button switch 28 no longer operates, and the switch 28 operates in a repeating sequence to start the timer, or to cause it to pause without losing track of the amount of exercising already completed.

During operation of the timing clock 10, the clock circuit 42 provides a signal having a regular frequency to the CPU 40, controlling the frequency at which the CPU 40 interrogates the EPROM 44 and RAM 46, in accordance with the instructions of the program stored in the EPROM 44.

For each "set" of an interval training workout, the CPU causes signals to be transmitted to the versatile interface adaptor 48, which causes the visual displays 49 to show that it is an exercise period, by lighting the indicator lamp 30, and to display the amount of time remaining at the beginning of the exercise period. As time elapses the CPU 40 causes the interface adaptor 48 to send appropriate signals to the decoder-driver **49*a*, which converts binary-coded decimal data to 7-segment display control signals, and to the 3-to-8 decoder 49*b*, which energizes each numeral of the digital display at the proper time, to change the visual display periodically, displaying the seconds and minutes remaining in decreasing numbers until the complete exercise period has elapsed. Preferably, individual display digit information is provided by the CPU 40 to the visual display 49** portion of the device in multiplex form, and each digit is displayed separately so frequently that display of all digits appears to be continuous.

Upon completion of the exercise period, the CPU 40 initiates the production of an identifiable end-of-exercise audio signal, for example, a pair of audio-frequency tones following one another in a predetermined sequence, as, for example, a short series of alternating 2-KHz and 1-KHz tones, beginning with a 2-Khz tone and ending with a 1-KHz tone. Thereupon, the rest period indicator lamp 32 is illuminated and the timer commences measurement of the rest period of time in the same fashion, with the current remaining amount of time during that rest period being displayed visually in countdown sequence as the time elapses.

Upon the expiration of the rest period of time, a distinguishably different audio frequency signal, consisting, for example, of the inverse of the end-of-exercise signal, is provided; thus, a series of alternating short 1-KHz and 2-KHz tones beginning with a 1-KHz tone and ending with a 2-KHz tone. Completion of the rest period ends the set; thereupon, the number shown in the "sets" display 16 is decreased by one, and the CPU 40 interrogates the RAM 46 to determine the length of the next exercise period. Measurement of the following exercise period then begins, as the exercise period indicator lamp 30 is illuminated. This sequence of events continues until the sets of exercise periods and rest periods programmed in the RAM 46 have been completed. Upon completion of the exercise period of the last programmed set, the CPU 40 generates a third type of audio signal, distinctively different from both the end of exercise period and end of rest period signals, indicating completion of the workout. This audio signal may be, for example, a series of short 1-KHz tones.

So long as the power supply to the timer 10 has not been interrupted, the timer can be restarted to time another, identical, workout by pressing the "start-/pause/clear" push-button switch 28. Doing so causes a signal to be transmitted via the versatile interface adaptor 48 to re-initiate the workout control by the CPU 40.

Although the use of other circuit components may be possible, the desired functions of the timer 10 may be carried out satisfactorily by the use of the commercially available circuit components listed below in Table 1 and connected as shown in FIGS. 3 and 4, when a suitable program is entered into the EPROM 44. The details of such a program do not form a part of the present invention, as they will depend upon the circuit components used in any particular emobidment of the invention, but are considered to be within the ability of a competent programmer. Since the functions of the timer to be controlled by such a program have been explained it is not deemed necessary to explain the program used in greater detail.

TABLE 1

| Reference No. | Commercial Part No. | Description | Common Manufacturer |
|---|---|---|---|
| 40 | 6502 | 1 MHz digital processor integrated circuit | Rockwell |
| 44 | 2716 or 2764 | 550 nanosecond EPROM integrated circuit | Texas Instruments |
| 46 | 6116 or 6264 | 300 nanosecond RAM | Hitachi |
| 48 | 6522 | 1 MHz Versatile Interface Adaptor (VIA) integrated circuit | Rockwell |
| 49 | DL704 | 7-segment light-emitting diode digital displays | Hewlett-Packard Corp. |
| 49a | 7448 | BCD to 7 segment decoder/driver | Texas Instruments |
| 49b | 74LS138 | 3-bit to 8-bit decoder | Texas Instruments |
| | 7404 | hexadecimal inverter | Texas Instruments |
| 52a | LM555 | monostable multivibrator | Texas Instruments |
| 56 | LM386 | audio amplifier | Texas Instruments |
| 58 | 74LS00 | quad 2-input | Texas |

TABLE 1-continued

| Reference No. | Commercial Part No. | Description | Common Manufacturer |
|---|---|---|---|
| | | NAND gate | Instruments |

The terms and expressions which have been employed in the forgoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A timer, comprising:

(a) countdown timing means for measuring the duration of each respective exercise period and rest period of a workout including a predetermined number of sequential sets, said predetermined number optionally being greater than one, each said set comprising a respective exercise period of time and each set except a final set including a respective subsequent rest period of time;

(b) countdown time display means for displaying visibly, during each said exercise period, a digital indication of the amount of time remaining in said exercise period, and for displaying visibly, during each said rest period, a digital indication of the amount of time remaining in said rest period;

(c) presettable countdown set counter means responsive to said countdown timing means, for determining the completion of each exercise set and calculating the number of exercise sets of said predetermined number remaining uncompleted in a workout; and (d) set count display means, responsive to said set counter means, for displaying a digital indication of the number of sets remaining uncompleted during said workout.

2. The timer of claim 1 including time input means for entering into said countdown timing means, as to each said set, a first amount of time corresponding to the length of the respective exercise period and a second amount of time corresponding to the length of the respective rest period, the timer further including set counter input means for establishing and storing an initial number of sets to be performed during said workout.

3. The timer of claim 1, including memory means interconnected with said timing means and said set counter means for storing data defining a plurality of different sets, each said set including a respective predetermined exercise period of time followed by a respective predetermined rest period of time, said timer further including means for causing said memory means to accept data defining a predetermined number of sets each including a last-entered exercise period of time and a last-entered rest period of time.

4. The timer of claim 1 wherein said countdown time display means comprises a single numerical display means for displaying an amount of time remaining during each said exercise period and each said rest period, said timer further including indicator means for indicating whether an amount of time displayed by said countdown time display means is part of an exercise period or a rest period.

5. The timer of claim 1 including audio signal means for signaling the end of said exercise period and said rest period of each said set.

6. The timer of claim 5 wherein said audio signal means includes means for providing a first audible signal indicating the end of each said exercise period and an audibly different second audible signal for indicating the end of each said rest period of each said set.

7. The timer of claim 5 wherein said audio signal means includes means for providing distinctive audible signal indicating the end of a workout.

8. The timer of claim 1 including reset means for preparing said timer for repeating the sequence of sets of a previously-programmed workout.

9. The timing device of claim 1 including selectable means for automatically and continuously repeating a previously programmed workout.

10. The timing device of claim 1 wherein said countdown time display means includes an electronically operated 7-segment digital display.

* * * * *

UNITED STATES PATENT AND TRADEMARK OFFICE

CERTIFICATE OF CORRECTION

PATENT NO. : 4,632,570

DATED : December 30, 1986

INVENTOR(S) : Terry D. Kelsey

It is certified that error appears in the above-identified patent and that said Letters Patent is hereby corrected as shown below:

| | |
|---|---|
| Col. 4, Line 63 | Change "erasible" to --erasable-- |
| Col. 5, Line 65 | Change "2-Khz" to --2-KHz-- |
| Col. 6, Line 39 | Change "emobidment" to --embodiment-- |
| Col. 7, Line 8 | Change "forgoing" to --foregoing-- |
| Col. 8, Line 33 | After "providing" insert --a-- |

Signed and Sealed this

Sixth Day of October, 1987

*Attest:*

*Attesting Officer*

DONALD J. QUIGG

*Commissioner of Patents and Trademarks*